US007392770B2

(12) United States Patent
Xiao

(10) Patent No.: US 7,392,770 B2
(45) Date of Patent: Jul. 1, 2008

(54) COOLING SYSTEM OF AN ENGINE FOR THE INSIDE OF A GENERATOR

(75) Inventor: Henglin Xiao, Wuxi (CN)

(73) Assignee: Wuxi Kipor Power Co., Ltd., Wuxi (CN)

( * ) Notice: Subject to any disclaimer, the term of this patent is extended or adjusted under 35 U.S.C. 154(b) by 0 days.

(21) Appl. No.: 10/577,339

(22) PCT Filed: Apr. 2, 2004

(86) PCT No.: PCT/CN2004/000302

§ 371 (c)(1),
(2), (4) Date: Feb. 22, 2007

(87) PCT Pub. No.: WO2005/042938

PCT Pub. Date: May 12, 2005

(65) Prior Publication Data

US 2007/0126235 A1 Jun. 7, 2007

(30) Foreign Application Priority Data

Oct. 28, 2003 (CN) ..... 2003 2 0110513 U

(51) Int. Cl.
*F01P 1/02* (2006.01)
*F02B 77/04* (2006.01)

(52) U.S. Cl. ..... 123/41.7; 123/198 E; 290/1 A

(58) Field of Classification Search ..... 123/2, 123/41.65, 41.7, 198 E; 290/1 A
See application file for complete search history.

(56) References Cited

U.S. PATENT DOCUMENTS 6,378,468 B1 * 4/2002 Kouchi et al. ..... 123/41.56

FOREIGN PATENT DOCUMENTS

JP 2000-337159 12/2000
JP 2002-309957 10/2002

* cited by examiner

*Primary Examiner*—Noah Kamen
(74) *Attorney, Agent, or Firm*—Hamre, Schumann, Mueller & Larson, P.C.

(57) ABSTRACT

The present invention relates to a cooling system for an engine inside a power generator, in the field of the power generator, which mainly includes a cool air suction hood, an engine housing side cover, an engine housing, a cool air cooling fan, an exhaust pipe; the cool air suction hood is jointed to the engine housing side cover, the left air guide plate and the right air guide plate on the upper of the engine secured to the engine housing, thus form two main cooling and ventilating chambers A and B on the left and right upper portion of the engine. An engine bottom air guide plate is secured to the bottom of engine housing side cover and forms the bottom cooling and ventilating chamber C of the engine with the side cover and an engine crank case rear cover. The engine crank case rear cover, the above-mentioned members, a heat insulation chamber body, a sealing ring and a heat insulation chamber rear hood form a double chamber cooling means of the secondary cooling cycle chamber D. The jointing surfaces of the cooling system are increased. The requirements for cooling the engine are more reasonable so that the portions of the engine with high heat are ensured to be timely cooled and provide a highly cooling effective for the engine.

8 Claims, 3 Drawing Sheets

COOLING SYSTEM OF AN ENGINE FOR THE INSIDE OF A GENERATOR

FIELD OF THE TECHNOLOGY

The present invention relates to a power generator, more particularly, to a cooling system for an engine inside a power generator.

DESCRIPTION OF THE RELATED ART

An enforced air-cooled engine requires adequate cool air for cooling the portions around the cylinders of the engine and the oil shell at the bottom of the engine. Because these two portions generate a mass of heat and are at so high temperature, so that the heat must be timely diffused to ensure that the engine keeps normal running and has a longer working life.

In the art, the cooling system for an engine inside the power generator generally has a fully enclosed cooling and ventilating chamber, i.e. the cooling hood and the guide hood of the cooling and ventilation chamber enclose the engine, the power generator, exhaust pipe and mufflers. The cool air taken in by the cooling fan cools all of the surfaces of the above-mentioned members and is exhausted out of the cooling and ventilating chamber through an exhaust channel. Such kind of the cooling structure has less connecting surfaces so that the cooling and ventilating chamber so constructed easily meets the sealing requirements, but can not ensure the timely cooling for the portions with a mass of heat in the engine (such as the circumference around the cylinder of the engine, the exhaust pipe and oil shell at the bottom of the engine).

SUMMARY OF THE INVENTION

The object of the present invention is to solve the technical problem as the above-mentioned, so as to provide a cooling system for an engine inside the power generator, which has a compact, simply, rational structure; and the connecting surfaces thereof is more with the requirements for cooling becoming reasonable; which also can ensure to timely cool the portions with a mass of heat in the engine and provide a high cooling effect.

The main technical solution according to the present invention for fulfilling the above-mentioned object is as follows:

A cooling system utilized for an engine inside a power generator includes a cool air suction hood (1), an engine housing side cover (2), an engine housing (6), a cool air cooling fan (9), an exhaust pipe (11); characterized in that, the cool air suction hood (1) is jointed to the engine housing side cover (2), the left air guide plate (3) and the right air guide plate (4) on the upper of the engine secured to the engine housing (6), thus form two main cooling and ventilating chambers (A) and (B) on the left and right upper portion of the engine with the cylinder head (5) and the engine housing (6)). An engine bottom air guide plate (7) is secured to the bottom of engine housing side cover (2) and forms the bottom cooling and ventilating chamber (C) of the engine with the side cover (2) and an engine crank case rear cover (8). The engine crank case rear cover (8), the cool air suction hood (1), the side cover (2), the left air guide plate (3) and the right air guide plate (4) on the upper of the engine, the cylinder head (5), the engine bottom air guide plate (7), the engine housing (6), a heat insulation chamber body (21), a sealing ring (22) and a heat insulation chamber rear hood (23) form a double chamber cooling means of the secondary cooling cycle chamber (D).

As compared with the existing technology in the art the advantages of the present invention are that:

This present invention has a simple, compact and rational structure. By using the cool air suction hood and cool air guides plate to partially enclose the engine, the power generator, the exhaust pipe and the muffler, the cool air taken in by the cooling fan continuously cool the above-mentioned members, which then is exhausted outside the chambers through the exhaust channel. Thus, according to the present invention, the jointing surfaces of the cooling system are increased. The requirements for cooling the engine are more reasonable so that the portions (such as the circumference around the cylinder of the engine, the exhaust pipe, the oil shell at the bottom of the engine) in the engine with a mass of heat are ensured to be timely cooled and provide a highly cooling effective for the engine.

DETAILED DESCRIPTION OF THE PREFERRED EMBODIMENT

Figure 1:
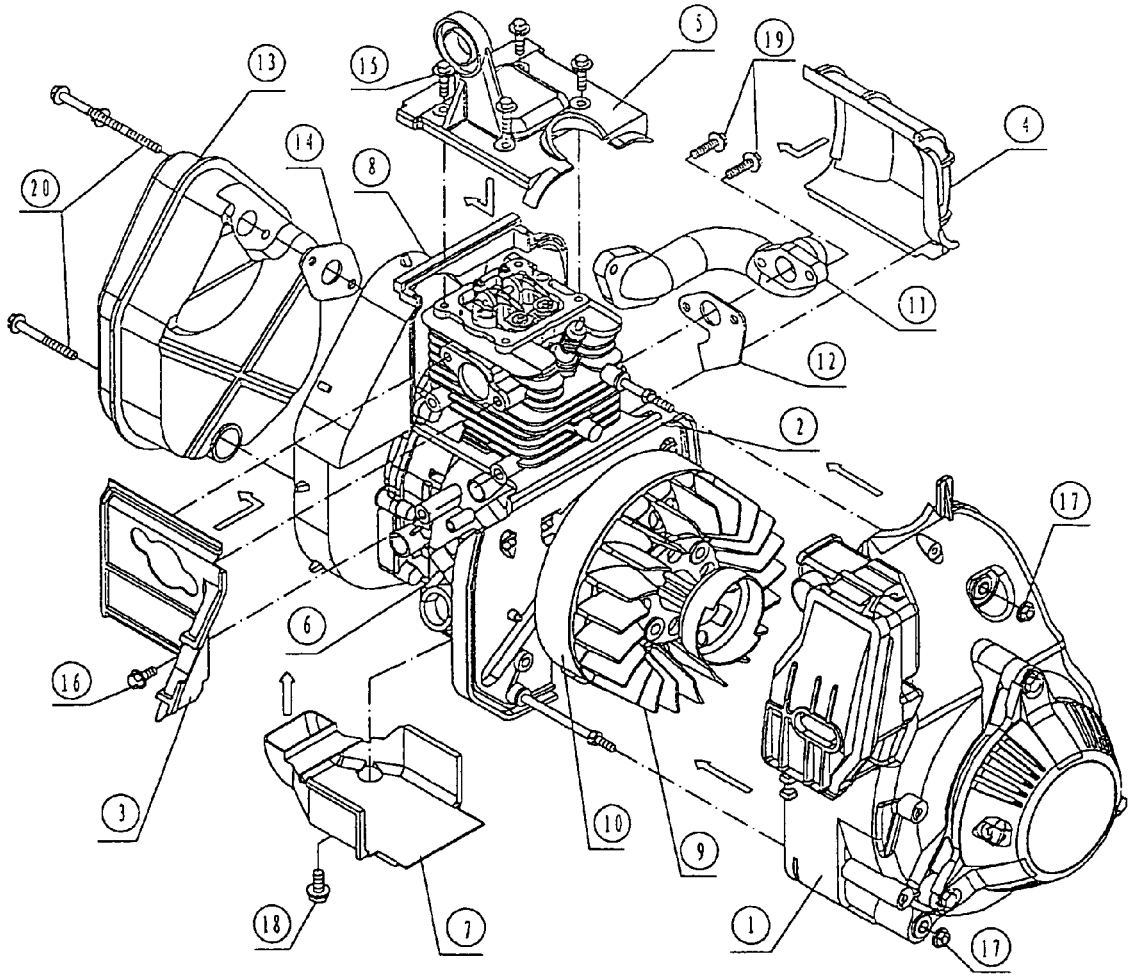
FIG. 1 is the schematic view of the general assembling according to the present invention.
Figure 2:
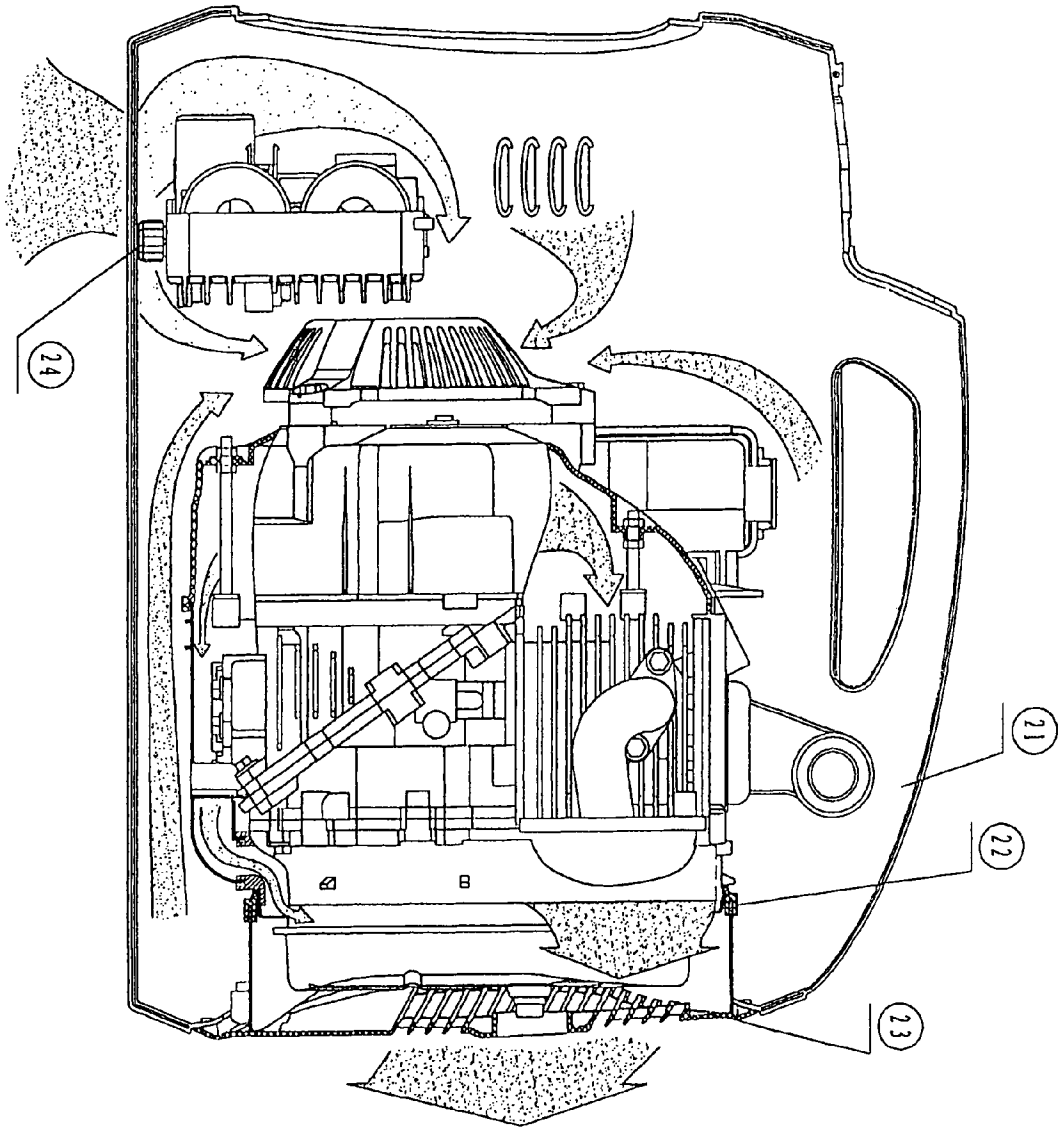
FIG. 2 is the schematic view showing the principle of the structure according to the present invention.
Figure 3:
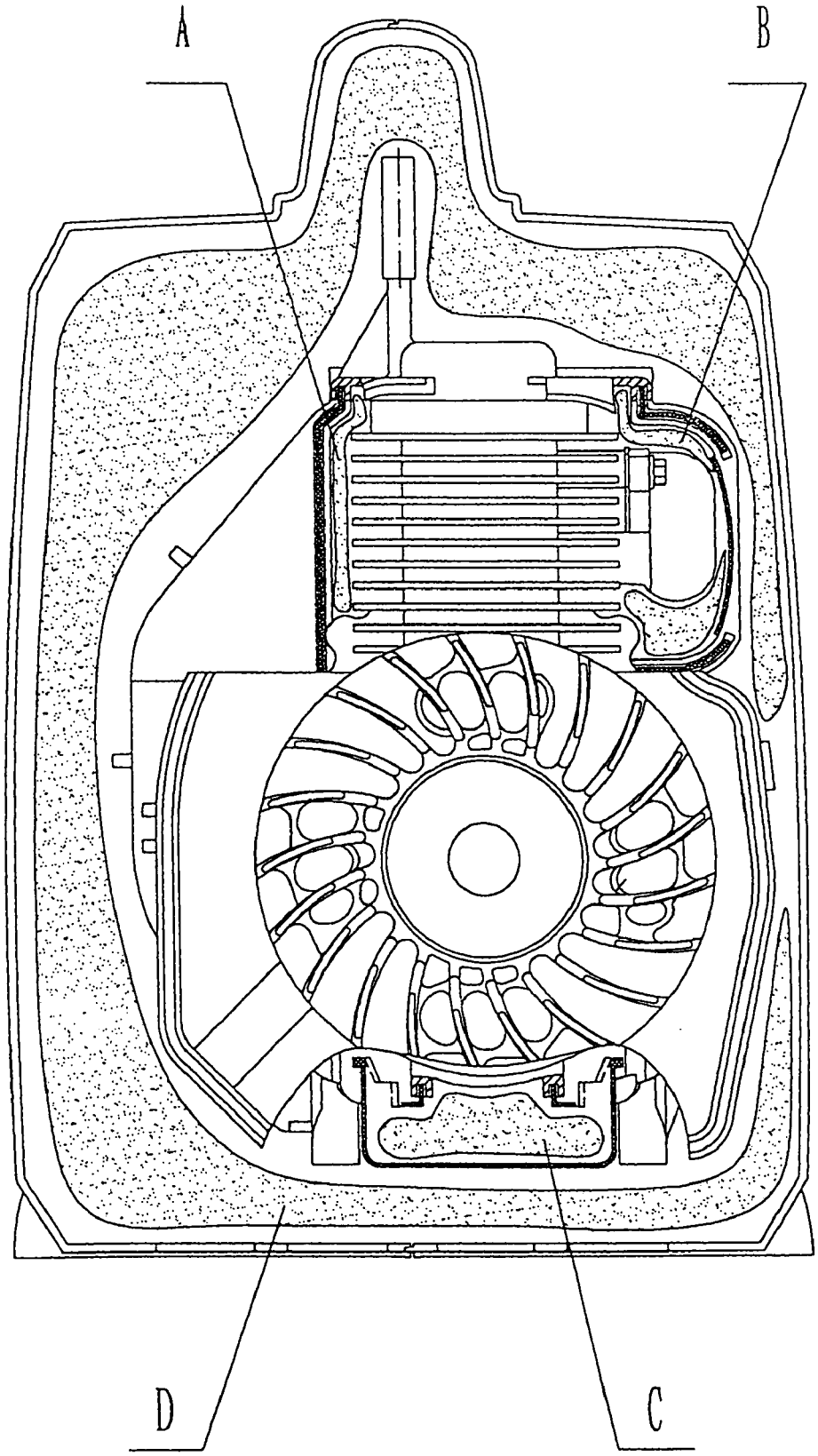
FIG. 3 is the schematic view showing the principle of the structure according to the present invention.

The features and advantages of the present invention will be clearly understood with reference to the following detailed description and the demonstration of the attached drawings of a preferred embodiment.

A cool air suction hood 1 according to the present invention is made by the process of polyester injection molding or aluminum-alloy die casting, and is connected to the side cover 2 of the engine housing with bolts 17. The left air guide plate 3 and the right air guide plate 4 on the upper of the engine are made by the process of polyester injection molding or steel sheet pressing, and are secured on the side surface of the engine housing 6 with bolts 16. The left air guide plate 3 and the right air guide plate 4 on the upper of the engine, the lifting lugs made by the process of aluminum-alloy die casting or steel sheet pressing, the engine cylinder hood 5 secured with the bolts 15 on the cylinder head of the engine and the engine housing 6 provided with engaging surfaces for the left and right air guide plates on the upper of the engine, all of them form two main cooling and ventilating chambers A, B on the upper of the engine. The air guide plate 7 on the bottom of the engine is made by the process of polyester injection molding or steel sheet pressing, and is secured to the bottom of the side cover 2 of the engine housing with bolts 18, which further forms the main cooling and ventilating chamber C on the bottom of the engine with the side cover 2 of the engine housing and the rear cover 8 of the engine crank case. The rear cover 8 of the engine crank case, the cool air suction hood 1, the side cover 2 of the engine housing, the left air guide plate 3 and the right air guide plate 4 on the upper of the engine, the cylinder heat hood 5, the bottom air guide plate 7, the engine housing 6, the heat insulation chamber 21, the sealing ring 22 and the heat insulation chamber rear cover 23 form a double-chamber cooling means of a secondary cooling cycle chamber D. The heat insulation chamber body 21 provides an air inlet groove in the front of the bottom thereof to ensure the cooling for the counter-converting module 24. The engine crank case rear cover 8 provided with the engaging grooves for the heat exhaust air hood and the air guide plate is made by the process of aluminum alloy die casting or steel sheet pressing, and is secured to the engine crank case rear cover with bolts.

The said tool air suction hood 1 has a built-in cooling fan 9 and a permanent magnet motor 10. Cooling fan 9 takes in cool air from atmospheric and a small quantity of hot air from the heat insulation chamber housing 21. The cool air firstly cools the permanent magnet motor 10 in the suction hood 1, and then goes through the left and right main cooling and ventilating chambers A and B and the main bottom cooling chamber C, and cools the radiator pieces in the upper of engine housing 6, the radiator pieces at the bottom of engine housing side cover 2 and the exhaust pipe 11, then goes on to the engine crank case rear cover 8 with the engaging grooves for the hot air exhaust hood and the air guide plates, and cools the muffler 13, finally goes through the exhaust grooves in the heat insulation chamber rear cover 23 and exhausts out of the chambers. The exhaust pipe 11 and a gasket 12 thereof are secured to the engine housing 6 with bolts 19. The muffler 13 is securely joined to the crank case rear cover 8 by bolts 20 with a muffler gasket 14 fixed therebetween.

The cooling system according to the present invention can be adapted to the design of cool air duct utilized for the enclosed housing type generator powered by enforced air-cooling engine.

The general assembling drawing depicts that: the cool air suction hood 1 is needed to be engaged with and inserted into the engine housing side cover 2, the left air guide plate 3 and the right air guide plate 4 on the upper of the engine, the bottom air guide plate 7. Thus, the cool air suction hood has at its engaging portion an injection mould insert-contacting member for fastening the left air guide plate 3, the right air guide plate 4 and the bottom air guide plate 7. The engaging portion of the side cover 2 of the housing is provided with a corresponding engaging groove to secure and seal the cool air suction hood 1.

The engine cylinder head hood 5 is needed to be engaged with and inserted into the left air guide 3, the right air guide plate 4 on the upper of the engine and the cool air suction hood 1. Thus, the cylinder head hood 5 has at its engaging portion a corresponding engaging groove for securing and sealing the left air guide plate 3 and the right air guide plate 4 on the upper of the engine. At the top of cylinder head hood 5 is provided with a lifting lug to facilitate the mounting of the engine. An engaging surface for the cool air suction hood 1 is provided at the corresponding engaging portion of the cylinder head hood 5 with a function of sealing. And, reinforcement ribs made by the process of injection molding are provided on the left air guide plate 3, the right air guide plate 4 on the upper of the engine and the bottom air guide plate 7 to improve whole strength.

The engine housing 6 has provided corresponding engaging surfaces at the portions jointed to the left air guide plate 3 and the right air guide plate 4 on the upper of the engine to ensure the sealing. The crank case rear cover 8 has the corresponding engaging grooves at the engaging portions joined to the left air guide plate 3 and the right air guide plate 4 on the upper of the engine, the bottom air guide 7 and the cylinder head hood 5 to ensure the sealing and fastening. Furthermore, the crank case rear cover 8 has provided with hot air exhaust hood that matches the heat insulation chamber rear hood 23, when fitted with seal ring 22, will meet the sealing requirements of main cooling and ventilating chambers A,B and C and the secondary cooling cycle chamber D.

If necessary, the left air guide plate 3, the right air guide plate 4 on the upper of the engine and the bottom air guide plate 7 are lined with their inner wall adhered with aluminum foil to enhance the reflection of heat source while reducing the temperature per Se. And, fire-resistance foam strips can be applied at all engaging portions to ensure reliable sealing.

The overall weight of the cool air suction hood 1 is reduced since it is made by the process of the polyester injection molding. The left air guide plate 3 and the right air guide plate 4 on the upper of the engine and the bottom air guide plate 7 are made by the process of polyester injection molding with the heat-resistant plastic so as to reduce the weight and lower the manufacturing cost The engine housing 6, the engine housing side cover 2, the engine crank case rear cover 8 and the engine cylinder head hood 5 are made by the process of aluminum alloy die casting to increase the heat defining area and reduce the weight of the engine, and to meet the sealing requirements and facilitate the mounting.

With the insert-contact engagement and the bolt-nut engagement among the cool air suction hood 1, the left air guide plate 3 and the right air guide plate 4 on the upper of the engine, the bottom air guide plate 7, the engine housing 6, the engine housing side cover 2, the engine crank case rear cover 8 and the engine cylinder head hood 5, the requirements of the sealing after assembling and the requirements of easy assembling can be achieved.

What is claimed:

1. A cooling system for an engine inside a power generator, comprising:

an engine housing;

a cool air suction hood in front of the engine housing, the cool air suction hood including a built-in cool air cooling fan;

an engine crank case on the rear side of the engine housing including a rear cover;

an engine side cover on the front side of the engine housing, the engine side cover being fastened to the cool air suction hood;

a left air guide plate being secured to the upper left side of the engine housing and a right air guide plate being secured to the upper right side of the engine housing;

a cylinder head hood on top of the engine housing and being secured to the left air guide plate, the right air guide plate and the cool air suction hood;

a bottom air guide plate on the bottom of the engine housing and being secured to the engine side cover;

a heat insulation chamber including the engine housing, the cool air cooling fan and the engine crank case therein, the heat insulation chamber having a heat insulation chamber body and a rear hood;

a scaling ring sealing a connection between the engine crank case and the rear hood of the heat insulation chamber;

a main left cooling and ventilating chamber on an upper left portion of the engine housing and being defined by the engine housing, the left air guide plate and the cylinder head hood;

a main right cooling and ventilating chamber on an upper right portion of the engine housing and being defined by the engine housing, the right air guide plate and the cylinder head hood; a main bottom cooling and ventilating chamber defined by the engine side cover, the rear cover of the engine crank case and the bottom air guide plate; and a double-cooling means including:

a first cooling means including the main left cooling and ventilating chamber, the main right cooling and ventilating chamber and the main bottom cooling and ventilating chamber;

a second cooling means including a secondary cooling cycle chamber defined by the engine side cover, the rear cover of the engine crank case, the cool air suction hood, the left air guide plate, the right air guide plate, the cylinder head hood, the bottom air guide plate, the engine housing, the heat insulation chamber body, the rear hood of the heat insulation chamber, and the sealing ring.

2. The cooling system according to claim 1, wherein the cool air suction hood is made by a process of polyester injection molding or aluminum-alloy die casting, and is connected to the engine side cover by bolts.

3. The cooling system according to claim 1, wherein the left air guide plate and the right air guide plate are made by a process of polyester injection molding or steel sheet pressing, and are secured on side surfaces of the engine housing by bolts, which form the main left cooling and ventilating chamber and the main right cooling and ventilating chamber on an upper portion of the engine housing together with the cylinder head hood provided with lifting lugs and an air guide plate engaging groove and the engine housing provided with an air guide plate engaging surface.

4. The cooling system according to claim 1, wherein the bottom air guide plate is made by a process of polyester injection molding or steel sheet pressing, and is secured to the bottom of the engine side cover by bolts.

5. The cooling system according to claim 1, wherein the rear cover of the engine crank case provided with engaging grooves for a heat exhaust air hood and an air guide plate is made by a process of aluminum alloy die casting or steel sheet pressing.

6. The cooling system according to claim 1, wherein the cylinder head hood is made by the process of aluminum alloy die casting or steel sheet pressing.

7. The cooling system according to claim 1, wherein the cool air suction hood has a permanent magnet motor the cool air cooling fan sucking in cool air from atmosphere and a slight quantity of hot air from the heat insulation chamber, the cool air firstly cooling the permanent magnet motor, and then passing through the main left and right cooling and ventilating chambers and the main bottom cooling and ventilating chamber, and cooling radiator pieces in the upper portion of the engine housing, radiator pieces at the bottom of the engine side cover and an exhaust pipe, then passing onto the rear cover of the engine crank case with engaging grooves for a hot air exhaust hood and an air guide plate, and cooling a muffler, and finally passing through exhaust grooves on the rear cover of the heat insulation chamber and exiting the heat insulation chamber.

8. The cooling system according to claim 1, wherein the heat insulation chamber body provides an air inlet groove in the front bottom thereof to ensure cooling for a voltage-converting module.

* * * * *

UNITED STATES PATENT AND TRADEMARK OFFICE

CERTIFICATE OF CORRECTION

PATENT NO. : 7,392,770 B2
APPLICATION NO. : 10/577339
DATED : July 1, 2008
INVENTOR(S) : Henglin Xiao It is certified that error appears in the above-identified patent and that said Letters Patent is hereby corrected as shown below:

Column 2, line 1: “technology in the art the” should read --technology in the art, the--.
Column 3, line 4: “said tool air suction hood” should read --said cool air suction hood--.
Column 4, line 10: “manufacturing cost The engine” should read --manufacturing cost. The engine--.
Column 4, line 49: “a scaling ring sealing a connection” should read --a sealing ring sealing a connection--.
Column 6, line 9 (claim 7): “magnet motor the cool” should read --magnet motor, the cool--.

Signed and Sealed this

Seventeenth Day of March, 2009

JOHN DOLL
*Acting Director of the United States Patent and Trademark Office*